United States Patent [19]

Flanagan

[11] 4,189,627

[45] Feb. 19, 1980

[54] ELECTROACOUSTIC TRANSDUCER FILTER ASSEMBLY

[75] Inventor: James L. Flanagan, Warren, N.J.

[73] Assignee: Bell Telephone Laboratories, Incorporated, Murray Hill, N.J.

[21] Appl. No.: 963,926

[22] Filed: Nov. 27, 1978

[51] Int. Cl.[2] ..... H04R 1/28

[52] U.S. Cl. ..... 179/180; 179/182 R; 179/187; 181/151; 181/160; 181/175; 181/196

[58] Field of Search ..... 179/178, 179, 180, 182 R, 179/187; 181/151, 160, 166, 175, 196, 197, 148, 155

[56] References Cited

U.S. PATENT DOCUMENTS

| | | | |
|---|---|---|---|
| 1,655,267 | 1/1928 | Hahnemann et al. | 181/166 |
| 1,757,938 | 5/1930 | Hayes | 179/180 |
| 1,837,755 | 12/1931 | Carlisle et al. | 181/160 |
| 2,097,289 | 10/1937 | Olson | 181/155 |
| 2,153,044 | 4/1939 | Jarnak | 179/180 |
| 2,236,568 | 4/1941 | Edson | 179/182 R |
| 2,697,141 | 12/1954 | Smith | 179/187 |
| 3,452,164 | 6/1969 | Kobara | 179/115 |
| 3,819,879 | 6/1974 | Baechtold | 179/179 |
| 3,944,756 | 3/1976 | Lininger | 179/111 E |
| 4,054,748 | 10/1977 | Balogh | 179/1 E |

FOREIGN PATENT DOCUMENTS

| | | | |
|---|---|---|---|
| 626623 | 7/1949 | United Kingdom | 179/179 |

*Primary Examiner*—George G. Stellar
*Attorney, Agent, or Firm*—Jack S. Cubert

[57] ABSTRACT

An electroacoustic transducer assembly adapted to filter sound waves in a digital communication system incorporates a plurality of tandemly arranged tubular members and a transducer. Each tubular member includes an apertured plate end, a tubular cavity and an open end. The open end of each tubular member is secured to the plate end of the adjacent tubular member to form a housing with a divided longitudinal passageway. The open end of the housing is secured to the transducer. Every tubular cavity is partitioned into longitudinal sections by structural elements to inhibit cross mode resonance. The apertures, cavity lengths and structural elements are dimensioned relative to the cavity cross sections to suppress passage of sound waves outside a predetermined frequency band.

16 Claims, 9 Drawing Figures

ELECTROACOUSTIC TRANSDUCER FILTER ASSEMBLY

My invention relates to electroacoustic transducer arrangements, and more particularly, to electroacoustic transducer filtering assemblies for use in digital communication systems.

BACKGROUND OF THE INVENTION

In digital communication systems, intelligence is generally conveyed in the form of sequential pulse codes. The transmission of an audio signal over a digital facility requires that the audio signal be sampled at a rate greater than twice the highest frequency to be transmitted. All frequency components of the audio signal and noise above one-half the sampling frequency must be suppressed prior to sampling. Otherwise, the modulation introduced by the sampling process results in a folded audio signal spectrum which appears as interference in the frequency range below one-half the sampling frequency. This effect, generally known as aliasing, is prevented by accurately controlling the passband of the audio signal prior to sampling.

While aliasing only occurs at transmitting terminals of a digital communication system where an audio signal is sampled, similar passband control arrangements are needed at receiving terminals of the digital facility. Otherwise, the modulation introduced by sampling results in an interferring audio signal above one-half the sampling frequency being applied to the receiving transducer. Electrical filters designed to prevent interference in digital sampling systems are complex and expensive since they must provide accurate filtering over the entire audio frequency range and must be inserted in each transmitting and receiving terminal of the communication system.

Acoustical filter networks have been incorporated in electroacoustic transducer assemblies to control the frequency characteristics of sound waves at the transducer. One such arrangement, disclosed in U.S. Pat. No. 3,819,879 issued June 25, 1974 to Werner Baechtold, provides a low pass acoustical filter integral with a telephone handset receiver cover. The cover is shaped so that sound waves from the transducer are directed through a pair of cavities dimensioned to attenuate higher frequency components. A dimensioned to attenuate higher frequency components. A Helmholtz resonator is incorporated in the receiver cover to provide absorption of sound at its resonant frequency. The Helmholz cavity resonant frequency is set just below one-half the sampling frequency of the digital facility to which the transducer is connected. In this way, the filtering required for digital communication of voice signals is achieved in a more economic manner.

The Baechtold scheme as well as other prior art acoustic filter networks (e.g., U.S. Pat. No. 3,452,164 issued June 24, 1969 to Kiyoshi Kobara) are adaped to modify the frequency characteristics of sound waves travelling along the axis of the acoustic network associated with a telephone receiver. Such arrangements are practical as long as structural dimensions of the acoustic network are small in comparison with the wavelenghts of the sound passing therethrough. When the sound wavelengths are comparable to the structural dimensions, as is generally the case in telephone type transducers and loudspeakers, the higher frequency sound waves cause resonance in the acoustic network. Consequently the unwanted sound wave frequencies are not adequately attenuated by the acoustic filter.

In analog communication systems, higher frequency sound waves outside the desired passband cause little difficulty since they are readily removed in the system. In digital communication systems utilizing sampling, however, the sound wave components of frequency greater than one-half the sampling frequency whose wavelengths are comparable to the acoustic network dimensions partially pass through the network. As aforementioned, these unwanted components are folded into the desired signal frequency band and cause serious interference at transmitter terminals or are passed through the acoustic network associated with the receiving transducer at receiver terminals.

BRIEF SUMMARY OF THE INVENTION

The invention is directed to an electroacoustic transducer assembly that includes a transducer and a housing having an apertured plate end, an open end and a longitudinal passageway of predetermined length and cross section. The open end of the housing is secured to the transducer and a plurality of apertured plates are secured in the housing at spaced intervals along the passageway. Each spaced interval includes structural elements that partition the spaced interval into a plurality of longitudinal sections to inhibit resonance of the housing. The spaced intervals, the apertures in the plates, and the structural elements are dimensioned relative to the passageway cross section to suppress passage of sound waves outside a predetermined frequency band through the passageway.

According to one aspect of the invention, the orientation of the partitioned sections of each spaced interval is offset from the orientation of the adjacent spaced interval partitioned sections.

According to another aspect of the invention, the partitioned sections of at least one spaced interval further includes a tubular chamber secured between adjacent plates at apertures therein. The chamber sidewall has apertures opening in the partitioning sections.

According to yet another aspect of the invention, the electroacoustic transducer assembly includes a transducer containing end plate and a plurality of tubular members. Each tubular member comprises an apertured plate end, an open end and a tubular cavity of predetermined cross section. The tubular members are tandemly arranged with the open end of a tubular member being secured to the plate end of the adjacent tubular member to form a housing having a divided longitudinal passageway therethrough. Each tubular cavity is partitioned into longitudinal sections by structural elements to inhibit resonance of the member. The apertures, the lengths of tubular cavities, and the structural elements are dimensioned relative to the tubular cavity cross sections to suppress passage of sound waves outside a predetermined frequency band through said passageway.

According to yet another aspect of the invention, the transducer assembly forms a part of a digital communication system having a predetermined sampling frequency. The apertures in the plate ends of the tubular members, the lengths of the tubular cavities, and the structural members are dimensioned relative to the tubular member cross sections to allow substantially uniform passage of sound waves below one-half the sampling frequency of the digital facility and to suppress passage of sound waves at and above one-half said sampling frequency through said passageway. The resonant chambers and apertures therein are dimensioned to produce resonance at one-half the sampling frequency.

DETAILED DESCRIPTION

Figure 1:
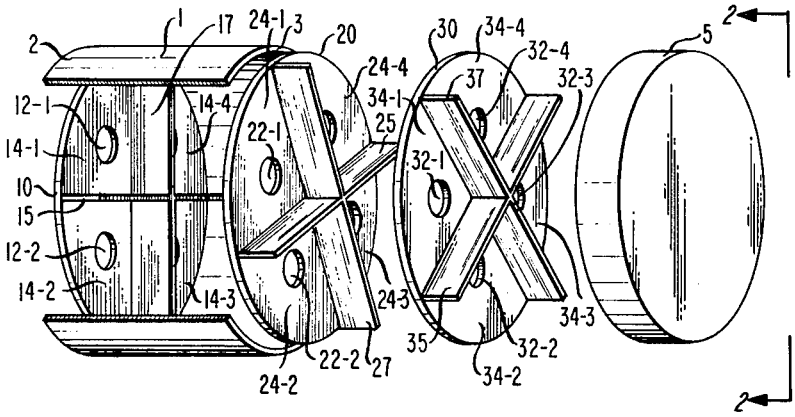
FIG. 1 depicts an exploded view of a cylindrical transducer assembly illustrative of the invention.

FIG. 1 depicts an exploded view of an electroacoustic transducer assembly illustrative of the invention in which apertured plate 10 is secured to open end 2 of cylindrical housing 1. Structural cross members 15 and 17 are attached to the right side of apertured plate 10. Plate 10 is divided into four sectors by cross members 15 and 17, and each sector has at least one aperture, e.g., 12-1, 12-2, 12-3, and 12-4. In like manner, apertured plate 20 is divided into four sectors by structural elements 25 and 27, and apertured plate 30 is similarly divided by cross members 35 and 37.

Plate 20 is inserted into housing 1 so that its left side contacts structural cross members 15 and 17, and plate 30 is inserted so that its left side contacts structural members 25 and 27. Transducer 5, which may be a microphone, a telephone receiver, or a loudspeaker, is secured to end 3 of housing 1. The electroacoustic transducer assembly of FIG. 1 is thereby divided into a series of three cavities, the dimensions of which are determined by the structural elements and the cross section of housing 1. Each cavity is partitioned into four longitudinal sectors by the structural elements therein. For example, the cavity between plates 10 and 20 is divided into sectors 14-1, 14-2, 14-3 and 14-4 by structural elements 15 and 17, and the cavity length is determined by the width of rectangular cross members 15 and 17.

It is well known in the art that cross mode resonances may occur in acoustic cavities when the wave lengths of sound waves applied thereto are comparable to the transverse dimensions of the cavity. The diameter of a standard telephone handset microphone or receiving device is such that the cavity resonances therein are well within the audio range. The longitudinal partitioning of the cavities by structural elements in accordance with the invention is operative to inhibit resonances in the audio range so that the aforementioned sampling modulation effects occurring in digital facilities are avoided.

In the arrangement of FIG. 1, plate 10 is oriented in housing 1 so that structural member 15 is horizontal and structural member 17 is vertical. Plate 20 is rotated clockwise with respect to plate 10 whereby the orientation of structural members 25 and 27 is offset from the orientation of structural members 15 and 17 and apertures 22-1, 22-2, 22-3 and 22-4 are free of interference from structural members 15 and 17. In similar manner, plate 30 is rotated clockwise with respect to plate 20 whereby the orientation of structural members 35 and 37 is offset from the orientation of members 25 and 27 and apertures 32-1, 32-2, 32-3 and 32-4 are out of line with structural members 25 and 27.

The different orientations of the structural members attached to plates 10, 20 and 30 are effective to further inhibit the resonance of housing 1 responsive to sound waves of wavelengths comparable to the diameter of the housing. The offset relationship of the apertures in plate 10, 20 and 30 insures that each cavity in housing 1 is operative independently of the other cavities to control the sound waves passing through the housing. Although the structural elements in FIG. 1 are pairs of perpendicular members, it is to be understood that other structural element configurations provide similar results. For example, a greater number of structural elements may be used or curved structural elements may be employed. Further, the aperture arrangement of FIG. 1 may be modified to include a plurality of apertures in each cavity sector so long as the adjacent structural elements do not intersect the apertures.

Figure 2:
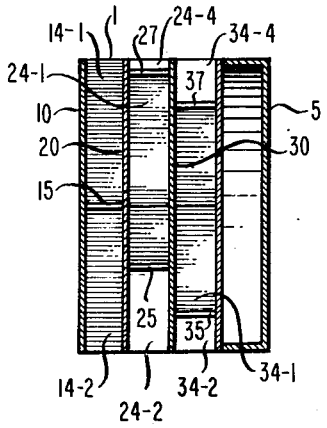
FIG. 2 shows a sectional view of the transducer assembly of FIG. 1.

FIG. 2 shows a cross section of the assembled transducer arrangement depicted in FIG. 1 taken through line 2-2 where transducer 5 is a cylindrical microphone adapted to receive sound waves from sound source 50. The sound waves enter sectors 14-1, 14-2, 14-3 and 14-4 of the cavity between plates 10 and 20 through apertures 12-1, 12-2, 12-3 and 12-4. Each aperture exhibits an acoustic inertance corresponding to $$L=\rho/d$$

where $\rho$ is the air density and d is the aperture diameter. The aperture also exhibits a loss factor R associated primarily with the viscous loss at the wall of the aperture. Additional viscous loss may be provided by covering the aperture with a silk screen or cloth. The value of the loss factor R in the arrangement of FIGS. 1 and 2 is determined experimentally as is well known in the art.

Each sector of the cavity between plates 10 and 20 is effective as an acoustic compliance $$C \cong Al/\rho c^2$$

where A is the cross section area of the sector, 1 is the axial length of the cavity and c is the velocity of sound. A conductance G is representative of the loss in the sector which is primarily associated with the heat conductance of the sector walls. The conductance G is determined experimentally for the configuration of FIGS. 1 and 2 as is well known in the art.

Sound waves from source 50 are modified by passage through apertures 12-1, 12-2, 12-3 and 12-4, and cavity sectors 14-1, 14-2, 14-3 and 14-4. The modified sound waves then enter cavity sectors 24-1, 24-2, 24-3 and 24-4 between plates 20 and 30 via apertures 22-1, 22-2, 22-3 and 22-4, and are altered therein in accordance with the aperture and cavity dimensions. After passage through apertures 32-1, 32-2, 32-3 and 32-4 in plate 30, and cavity sectors 34-1, 34-2, 34-3 and 34-4, the further modified sound waves are applied to microphone 5. The apertures in plates 10, 20 and 30, the cavity sector lengths and the structural elements of FIGS. 1 and 2 are dimensioned relative to the cross section of housing 1 so that passage of sound waves of frequencies outside a predetermined band is suppressed.

Figure 3:
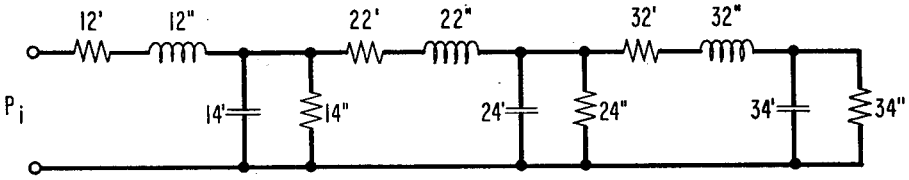
FIG. 3 shows an equivalent electrical circuit for the transducer assembly of FIGS. 1 and 2.

FIG. 3 shows an electrical circuit equivalent of the acoustic network of FIGS. 1 and 2. In FIG. 3 resistances 12', 22' and 32' represent the equivalent acoustic losses of the apertures in plates 10, 20 and 30, respectively. Inductances 12'', 22'' and 32'' represent the equivalent acoustic inertances of the apertures in plates 10, 20 and 30, respectively. Capacitance 14' represents the equivalent acoustic compliance of cavity sectors 14-1, 14-2, 14-3 and 14-4, while conductance 14'' corresponds to the combined acoustic losses of the sectors. In similar manner, capacitance 24' represents the combined acoustic compliance of cavity sectors 24-1, 24-2, 24-3 and 24-4, and capacitance 34' represents the equivalent acoustic compliance of cavity sectors 34-1, 34-2, 34-3 and 34-4. Conductances 24'' and 34'' represent the equivalent losses of sectors 24-1, 24-2, 24-3 and 24-4, and sectors 34-1, 34-2, 34-3 and 34-4, respectively.

As is well known in the art, the circuit of FIG. 3 is of the uniform ladder type and its transfer function is $$P_d/P_i=1/(x^3+5x^2+6x+1)$$

where $$x=z_1/z_2$$

$$z_1=R+j\omega L$$

and $$z_2=1/(G+j\omega C)$$

R is the equivalent loss of the apertures of a plate;
L is the equivalent inertance of the apertures of the plate;
C is the equivalent compliance of the sectors of a cavity;
G is the equivalent loss of the sectors of a cavity;
$P_d$ is the sound pressure at the transducer; and
$P_i$ is the sound pressure at plate 10.

Figure 5:
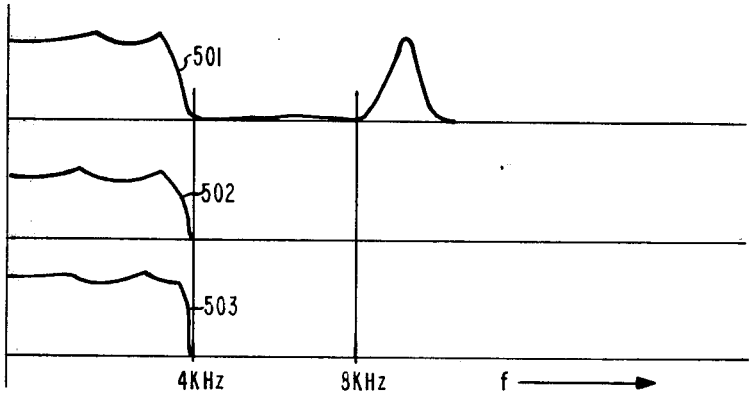
FIG. 5 shows waveforms illustrating the frequency responses of the transducer assemblies of FIGS. 1, 2, and FIG. 4.

Waveform 502 of FIG. 5 illustrates the frequency response of a transducer assembly constructed in accordance with FIGS. 1 and 2 for use in a digital facility where transducer 5 is an electret microphone having a diameter of 46 millimeters and the sampling frequency is 8 kilohertz. The equivalent ladder circuit of FIG. 3 for the sectored cavity arrangement of FIG. 1 includes inductances of $1.61\times10^{-3}$ cgs units, capacitances of $4.0\times10^{-6}$ cgs units, aperture loss resistances 7.5 cgs units and negligible cavity loss conductances. These parameters represent the parallel connection of the four partitioned cavity sectors. The apertures in FIG. 1, to obtain the desired inductances and resistances are 4.5 millimeters in diameter and the cavity lengths to obtain the desired capacitances are 4.3 millimeters. As shown in waveform 502 of FIG. 5, the frequency response is generally uniform up to 3.5 kilohertz, falls off to a low value at 4 kilohertz and remains at the low value in the remainder of the audio spectrum. Waveform 501 of FIG. 5 illustrates the frequency response obtained for the transducer assembly of FIGS. 1 and 2 where the structural members in the cavities are omitted. Waveform 501 exhibits a distinct unwanted response in the range of 8 to 10 kilohertz which response results from the aforementioned cross mode resonance of the plates and the housing. In accordance with the invention, the higher frequency resonances caused by sound waves of wavelength comparable to the 46 millimeter microphone diameter are inhibited by the inclusion of differently oriented cavity cross members.

Figure 4:
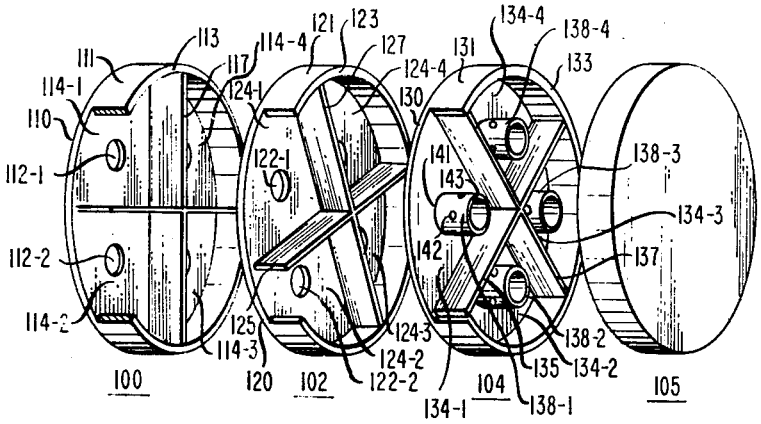
FIG. 4 depicts an exploded view of a modified cylindrical transducer assembly illustrative of the invention.

FIG. 4 shows an exploded view of another transducer assembly illustrative of the invention. In FIG. 4 cylindrically shaped tubular members 100, 102 and 104 are tandemly arranged to form a housing with a divided passageway therethrough. Tubular member 100 includes apertured plate end 110, cylindrical wall 111 and open end 113. Perpendicularly crossed rectangular members 115 and 117 attached to plate end 110 and wall 111 partition the cavity of tubular member 100 into sectors 114-1, 114-2, 114-3 and 114-4. Each sector of plate end 110 includes an aperture centered in the sector, e.g., aperture 112-1 is centered within sector 114-1. Similarly, tubular member 102 has an apertured plate end 120, a cylindrical wall 121 and an open end 123. Crossed rectangular members 125 and 127 partition the cavity of tubular member 102 into four sectors 124-1, 124-2, 124-3 and 124-4. Sound waves enter each of the sectors via an aperture, e.g., sector 124-1 is entered via aperture 122-1.

Tubular member 104 comprises apertured plate end 130, cylindrical wall 131 and open end 133. Crossed rectangular elements 135 and 137 partition the cavity of tubular member 104 into sectors 134-1, 134-2, 134-3 and 134-4. An aperture is included in each sector and a cylindrical chamber having one end surrounding the sector aperture extends the length of the cavity from plate end 130 to transducer 105. Chamber 138-1 in sector 134-1, for example, includes end 141 attached to plate 130 around the aperture in sector 134-1. Cylindrical wall 143 extends from plate 130 to transducer 105 and has four equally spaced apertures therein, e.g., aperture 142, which apertures communicate between the chamber cavity within wall 143 and the cavity sector 134-1. Sectors 134-2, 134-3, and 134-4 also include apertured chambers 138-2, 138-3 and 138-4, respectively. The construction of each of these chambers is substantially similar to the construction of chamber 138-1. Each chamber and the apertures therein are dimensioned to resonate at a predetermined frequency, i.e., one-half the sampling frequency of the associated digital facility.

The transducer arrangement of FIG. 4 is assembled by securing open end 113 of tubular member 100 to plate end 120, securing open end 123 of tubular member 102 to plate end 130 of tubular member 104, and securing open end 133 of tubular member 104 to the periphery of transducer 105. The tubular members and the transducers are positioned so that there is a common longitudinal axis. As described with respect to FIGS. 1 and 2, the orientation of the rectangular structural elements of each plate is offset to inhibit cross mode resonances of the tubular members. In FIG. 4, rectangular element 115 is horizontal and rectangular element 117 is vertical. The orientation of tubular member 102 is rotated clockwise with respect to tubular member 100 whereby the structural members and the apertures of plates 100 and 120 are offset. Similarly, the orientation of tubular member 104 is rotated clockwise with respect to tubular member 102 whereby the structural elements and apertures of plate 130 are offset from the structural elements and apertures of plate 120.

Sound waves enter cavity sectors 114-1 through 114-4 via apertures 112-1 through 112-4, and are modified in accordance with the dimensions of the cavity sectors of tubular member 100. The modified sound waves then enter cavity sectors 124-1 through 124-4 via apertures 122-1 through 122-4 and are altered in tubular member 102. The sound waves from tubular member 102 enter cylindrical chambers 138-1 through 138-4 via the apertures in plate 130. A portion of the sound waves in the chambers is applied directly to transducer 105. Another portion of the sound waves sectors 134-1 through 134-4 via the apertures in the tubular chambers and are applied to transducer 105 via cavity sectors 134-1 through 134-4.

Figure 6:
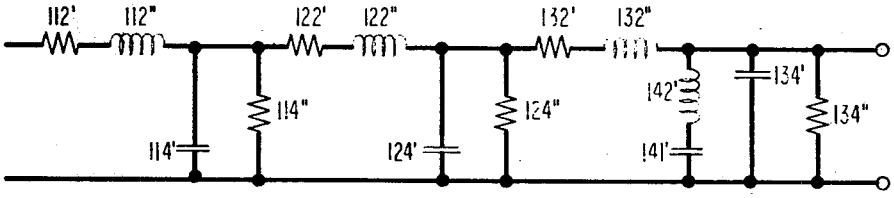
FIG. 6 shows an equivalent electrical circuit of the modified cylindrical transducer assembly of FIG. 4.

FIG. 6 shows the equivalent electrical circuit for the accoustic network of FIG. 4. In FIG. 6 resistance 112' and inductance 112" represent the combined viscous loss and inertance of apertures 112-1 through 112-4. Capacitance 114' and conductance 114" represent the combined compliance and loss of cavity sectors 114-1 through 114-4. Resistance 122' and inductance 122" is equivalent to the combined viscous loss and inertance of apertures 122-1 through 122-4, while capacitance 124' and conductance 124" are equivalent to the combined compliance and loss of cavity sectors 124-1 through 124-4. Similarly, resistance 132' and inductance 132" represent the combined viscous loss and inertance of the apertures in plate end 130. Capacitance 134' and conductance 134" represent the combined compliances and losses of cavity sectors 134-1 through 134-4, excluding chambers 138-1 through 138-4.

The combined inertances of the apertures in the chamber walls of tubular chambers 138-1 through 138-4 are represented by inductance 142' and the combined compliances of chambers 138-1 through 138-4 are represented by capacitance 141'. Capacitance 141' and inductance 142' form a series resonance circuit having a resonant frequency of one-half the sampling frequency of the associated digital communication system. This resonance circuit is in parallel with capacitance 134' in FIG. 6. The frequency response of the transducer assembly of FIG. 4 for a cylindrical microphone having a diameter of 46 millimeters and a sampling frequency of 8 kilohertz is shown in waveform 503 of FIG. 5. As mentioned with respect to waveform 502, the inclusion of differently oriented structural members in the cavities of tubular members 100, 102 and 104 are operative to inhibit resonance of the assembled housing of FIG. 4 so that sound waves of frequencies above 4 kilohertz are suppressed. The inclusion of a plurality of cylindrical chambers in the cavity sectors between plate end 130 and transducer 105 modifies the frequency response of the transducer assembly in the region of one-half the sampling frequency whereby a much sharper cutoff characteristic is obtained for the acoustic filter network. While the transducer assembly of FIG. 4 utilizes resonant chambers in one tubular cavity, it is to be understood that resonant chambers may be included in other tubular members as well.

Figure 7:
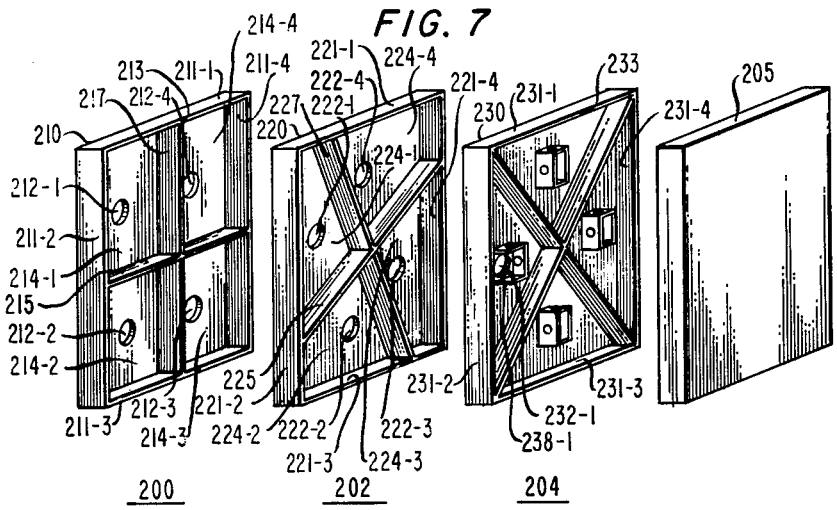
FIG. 7 depicts an exploded view of a rectangular transducer assembly illustrative of the invention.

FIG. 7 shows an exploded view of a transducer assembly illustrative of the invention which is adapted for use with a rectangular transducer 205. The assembly comprises rectangular cross section tubular members 200, 202 and 204. Tubular member 200 includes rectangular apertured end plate 210, sidewalls 211-1, 211-2, 211-3 and 211-4 which define a cavity, open end 213, and structural members 215 and 217 which partition the cavity into sections 214-1, 214-2, 214-3 and 214-4. Tubular member 202 similarly includes apertured plate end 220 which is secured to open end 213 of tubular member 200, sidewalls 221-1, 221-2, 221-3 and 221-4, and structural members 225 and 227 which partition the cavity of tubular member 202 into sections 224-1 through 224-4. Structural members 225 and 227 are skewed with respect to structural members 215 and 217 and apertures 222-1 through 222-4 in plate 220 are offset from apertures 212-1 through 212-4 in plate 210.

Apertured plate end 230 of tubular member 204 is secured to open end 223 of tubular member 202. Structural members 235 and 237 are attached to plate 230 and to sidewalls 231-1 through 231-4 to partition the cavity of tubular member 204 into sections 234-1 through 234-4. Open end 233 of tubular member 204 is secured to the periphery of transducer 205. The tubular members and the transducer are positioned along a common longitudinal axis through the centers of the tubular members. Each aperture in plate 230 communicates a rectangular cross section chamber which has apertures in its sidewalls. Chamber 238-1, for example, extends from plate 230 to transducer 205 in section 234-1 and the left end of chamber 238-1 surrounds aperture 232-1. Each sidewall of chamber 238-1 includes an aperture which communicates with section 234-1. Chambers 238-2, 238-3 and 238-4 are similarly arranged in sections 234-2, 234-3 and 234-4, respectively.

The orientation of structural elements 235 and 237 is rotatably offset from structural elements 225 and 227 in plate 220 and the apertures in plate 230 are displaced with respect to the apertures in plate 220. The differently oriented sections of the tandemly arranged cavities in FIG. 7 are operative to inhibit cross mode resonances of the assembled housing and the offset relationship of the apertures in plates 210, 220 and 230 allows each cavity to modify the sound waves passing therethrough independently of the adjacent cavities as aforementioned with respect to FIGS. 1 and 2 and FIG. 4.

Figure 8:
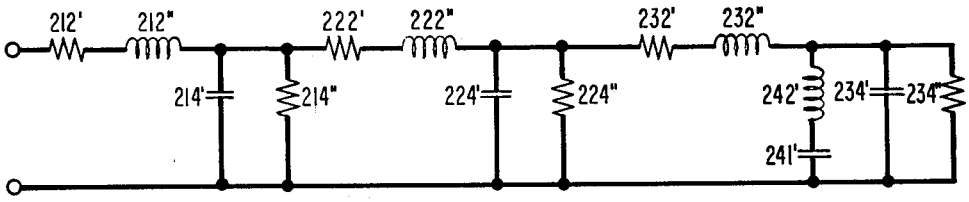
FIG. 8 shows an equivalent electrical circuit of the rectangular transducer assembly of FIG. 7.

The equivalent electrical circuit for the arrangement of FIG. 7 is shown in FIG. 8. Resistance 212', inductance 212", capacitance 214' and conductance 214" represent the acoustic characteristics of tubular member 200. Similarly, resistance 222', inductance 222", capacitance 224' and conductance 224" represent the acoustic characteristics of tubular member 202. With respect to tubular member 204, resistance 232' and inductance 232" represent the inertance and loss of the apertures in plate 230, and capacitance 234' and conductance 234" represent the combined characteristics of the cavity sections of tubular member 204. Inductance 242' represents the equivalent inertance of apertures in the sidewalls of chambers 238-1 through 238-4 and capacitance 241' represents the equivalent acoustic compliance of the chambers. The resonant frequency of chambers 238-1 through 238-4 may be set to one-half the sampling frequency of the associated digital facility to improve the cutoff characteristics of the acoustic network.

Figure 9:
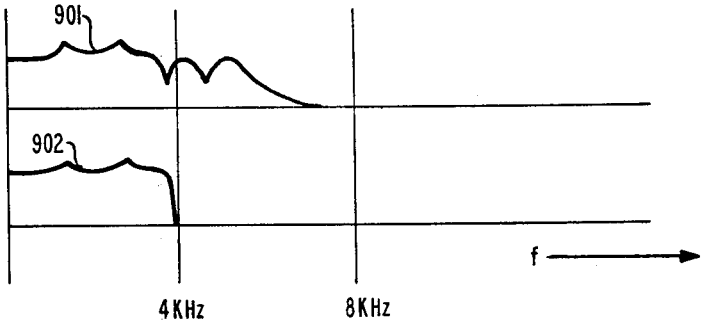
FIG. 9 shows waveforms illustrating the frequency response of the rectangular transducer assembly of FIG. 7.

Waveform 901 of FIG. 9 illustrates the frequency response of the arrangement of FIG. 7 for a sampling frequency of 8 kilohertz and a passageway cross section of 42.5 millimeters by 34.0 millimeters where the structural elements of the tubular members are removed. In the absence of the cavity partitioning structural elements, a resonance type response is evident in the region between 4 kilohertz and 6 kilohertz. A double peak response is obtained since two cross mode resonances are significant. Waveform 902 illustrates the frequency response of the assembly of FIG. 7 with the structural elements and chambers placed in the cavities of the tubular members. In accordance with the invention, cross mode resonances are inhibited in waveform 902 and the cutoff at 4 kilohertz, one-half the sampling frequency, is sharper due to the inclusion of resonant chambers 238-1 through 238-4.

The transducers in FIG. 1, 4 or 7 may be telephone receivers or loudspeaking devices. The function of the receiving transducer assembly is substantially similar to that of the microphone assembly. In a digital communication facility, the receiving transducer assembly replaces the electrical filter normally utilized to eliminate the audio frequency signals above one-half the sampling frequency which are present due to the sampling modulation effect. Where, for example, transducer 205 of FIG. 7 is a loudspeaker of a speakerphone set, sound waves from speaker 205 enter chambers 238-1 through 238-4 and sections 234-1 through 234-4 of tubular member 204. These sound waves are modified in accordance with the acoustic characteristics of tubular member 204 as shown in the electrical equivalent circuit of FIG. 8. The modified sound waves enter cavity sections 224-1 through 224-4 of tubular member 202 via the apertures in plate 230 and exit tubular member 202 via apertures 222-1 through 222-4 in altered form. The altered sound waves from tubular member 202 are further modified in sections 214-1 through 214-4 and in apertures 212-1 through 212-4 of tubular member 200 and the resulting sound waves absent frequency components above one-half the sampling frequency (e.g., caused by sampling modulation) are available from plate 210. The transducer assemblies shown in FIGS. 1 and 4 operate in similar manner when the transducers used are telephone receivers or loudspeaking devices.

While the invention has been described in terms of particular illustrative embodiments thereof, it is to be understood that modifications and alternative constructions may be made by those skilled in the art without departing from the spirit and scope of the invention. For example, the dimensions of the tubular chambers in FIGS. 4 and 7 may be made different from each other to extend the range of acoustic network filter characteristics; the angle between cross-member pairs in FIGS. 1, 4 and 7 may be other than 90 degrees to further inhibit cross-mode resonance; or the tubular members may be sectioned into many small divisions to further inhibit cross mode resonance.

I claim:

1. An electroacoustic transducer assembly comprising:

a transducer, a housing having an apertured plate end, an open end, and a longitudinal passageway of predetermined length and cross section therethrough, said housing open end being secured to said transducer; a plurality of apertured plates secured to said housing at spaced intervals along the passageway; and means comprising structural elements in each spaced interval for partitioning said spaced interval into longitudinal sections to inhibit resonance of said housing; said spaced intervals, said apertures and said structural elements being dimensioned relative to said passageway cross section to suppress passage of sound waves outside a predetermined frequency band through said passageway.

2. An electroacoustic transducer assembly according to claim 1 wherein the orientation of the partitioned sections of each spaced interval is offset from the orientation of the adjacent spaced interval partitioned sections.

3. An electroacoustic transducer assembly according to claim 2 wherein each partitioned section of at least one spaced interval further comprises:

a tubular chamber secured between adjacent plates at apertures therein; and a chamber enclosure having apertures opening into said partitioned section.

4. An electroacoustic transducer assembly comprising:

a transducer, a plurality of tubular members each having an apertured plate end, an open end, and a cavity of predetermined cross section; said tubular members being tandemly arranged with the open end of one tubular member secured to the plate end of the adjacent tubular member to form a housing having a longitudinal passageway therethrough; each tubular member further comprising means comprising structural elements for partitioning said tubular cavity into longitudinal sections to inhibit resonance of said housing; the tubular cavity lengths, the apertures in said plate ends and the structural members being dimensioned relative to said tubular cavity cross sections to suppress passage of sound waves outside a predetermined frequency band through said passageway.

5. An electroacoustic transducer assembly for a digital communication system having a predetermined sampling frequency comprising:

a transducer, a plurality of tubular members each having an apertured plate end, an open end, and a cavity of predetermined cross section; said tubular members being tandemly connected with the open end of one tubular member secured to the plate end of the adjacent tubular member to form a housing having a longitudinal passageway therethrough; each tubular member further comprising means comprising structural elements for partitioning its cavity into longitudinal sections to inhibit resonance of said tubular member; the apertures in said plate ends, the lengths of said tubular cavities, and said structural elements being dimensioned relative to said tubular cavity cross sections to suppress passage of sound waves of frequencies above one-half said sampling frequency through said passageway.

6. An electroacoustic transducer assembly according to claim 5 wherein the plate end of each tubular member includes at least one aperture in each partitioned section thereof.

7. An electroacoustic transducer assembly according to claim 6 wherein the orientation of the partitioned sections of one tubular member is offset relative to the orientation of the partitioned sections of the adjacent tubular members of said housing.

8. An electroacoustic transducer assembly according to claim 7 wherein at least one tubular member of said housing further comprises a resonant tubular chamber within each partitioned section; said resonant tubular chamber having one open end secured to the plate end of the tubular member, another open end in peripheral contact with the plate end of the adjacent tubular member or the transducer, and a chamber enclosure along the length of said tubular member section having apertures opening into said partitioned section; said chamber enclosure cross section and said chamber enclosure apertures being dimensioned to resonate said chamber at one-half the sampling frequency.

9. An electroacoustic transducer assembly according to any of claims 4, 5, 6, 7 or 8 wherein each tubular member cross section is circular and said structural elements partition said tubular member cavity into cylindrical sectors.

10. An electroacoustic transducer assembly according to any of claims 4, 5, 6, 7 or 8 wherein each tubular member is rectangular and said structural elements partition said tubular member into sections.

11. An electroacoustic transducer assembly according to any of claims 4, 5, 6, 7, or 8 wherein said electroacoustic transducer assembly is a microphone.

12. An electroacoustic transducer assembly according to any of claims 4, 5, 6, 7 or 8 wherein said electroacoustic transducer assembly is a telephone receiving device.

13. An electroacoustic transducer assembly according to any of claims 4, 5, 6, 7 or 8 wherein said electroacoustic transducer is a loudspeaker device.

14. An electroacoustic transducer assembly in a digital communication system having a predetermined sampling frequency comprising:

a transducer, first, second and third tubular members each including a multiapertured plate end, an open end, and a tubular cavity of predetermined cross section; the open end of said first tubular member being secured to said transducer, the open end of said second tubular member being secured to the plate end of said first tubular member, the open end of said third tubular member being secured to the plate end of said second tubular member; the cavities of said first, second and third tubular members forming an apertured plate divided passageway having a common longitudinal axis; each tubular member further comprising means comprising structural elements connected to its plate end for partitioning its cavity into longitudinal sections to inhibit resonance of said tubular member; said apertures, tubular cavity lengths, and structural elements being dimensioned relative to the tubular cavity cross sections to suppress passage of sound waves of frequencies above one-half said sampling frequency through said passageway.

15. An electroacoustic transducer assembly according to claim 14 wherein the orientation of the longitudinal sections of each tubular member is offset from the orientation of the longitudinal sections of the other tubular members.

16. An electroacoustic transducer assembly according to claim 15 wherein said first tubular member includes a resonant tubular chamber within each partitioned longitudinal section; each tubular chamber having one open end secured to the plate end of said first tubular member, an other open end peripherally contacting said transducer, and a chamber enclosure along the length of said first tubular member having apertures opening into said partitioned section; said chamber enclosure cross section and said chamber enclosure apertures being dimensioned to resonate said chamber at one-half the sampling frequency.

* * * * *

UNITED STATES PATENT AND TRADEMARK OFFICE

CERTIFICATE OF CORRECTION

PATENT NO. : 4,189,627

DATED : February 19, 1980

INVENTOR(S) : James L. Flanagan

It is certified that error appears in the above-identified patent and that said Letters Patent are hereby corrected as shown below:

Column 1, lines 47-48, "A dimensioned to attenuate higher frequency components." should be deleted; line 58, "adaped" should read --adapted--. Column 5, line 35, "(G+jwC)" should read --G+jwC--.

Signed and Sealed this

*Fifteenth* Day of *July 1980*

[SEAL]

*Attest:*

SIDNEY A. DIAMOND

*Attesting Officer*

*Commissioner of Patents and Trademarks*